United States Patent [19]

Wagner

[11] 4,120,367

[45] * Oct. 17, 1978

[54] PNEUMATIC IMPACT GUN

[75] Inventor: David Lee Wagner, Kent, Wash.

[73] Assignee: The Boeing Company, Seattle, Wash.

[ * ] Notice: The portion of the term of this patent subsequent to Aug. 2, 1994, has been disclaimed.

[21] Appl. No.: 782,806

[22] Filed: Jul. 8, 1977

Related U.S. Application Data

[63] Continuation-in-part of Ser. No. 699,772, is a continuation-in-part of Ser. No. 591,972, Jun. 30, 1975, abandoned.

[51] Int. Cl.[2] ..... B21J 15/18

[52] U.S. Cl. ..... 173/137

[58] Field of Search ..... 91/5; 173/15, 135, 136, 173/137

[56] References Cited

U.S. PATENT DOCUMENTS

| | | | |
|---|---|---|---|
| 2,303,666 | 12/1942 | Souter | 91/5 |
| 2,933,068 | 4/1960 | Johnson et al. | 173/137 X |
| 2,943,328 | 7/1960 | Carpenter et al. | 173/15 |
| 3,111,997 | 11/1963 | Krembel | 173/15 |
| 3,216,510 | 11/1965 | Briden | 173/15 |
| 3,363,512 | 1/1968 | Ottestad | 91/5 |
| 3,385,378 | 5/1968 | Weber et al. | 173/15 |
| 3,762,160 | 10/1973 | Kramer | 91/5 X |
| 3,851,713 | 12/1974 | Fedosenko et al. | 91/5 X |

FOREIGN PATENT DOCUMENTS

| | | | |
|---|---|---|---|
| 40,882 | 2/1925 | Norway | 173/15 |

*Primary Examiner*—Lawrence J. Staab

*Attorney, Agent, or Firm*—Lynn H. Hess; Bernard A. Donahue

[57] ABSTRACT

A pneumatic impact gun having an accumulator and interlock system for rapidly dumping a predetermined amount of compressed air into a cylinder to thereby propel an associated piston toward an anvil for contact with a rivet to be upset. The interlock system prevents accidental firing of the gun until a normally open interlock valve is manually depressed. Thereupon, a trigger valve may be manually opened to permit compressed air from a source to open a main valve and charge the accumulator to a predetermined pressure. The air in the accumulator may then be rapidly dumped therefrom into contact with the piston. Additionally, a metering valve serves as an energy selector to permit selective charging of the accumulator for varying the resulting impact of the piston onto the anvil.

3 Claims, 4 Drawing Figures

AIR LOGIC SYSTEM
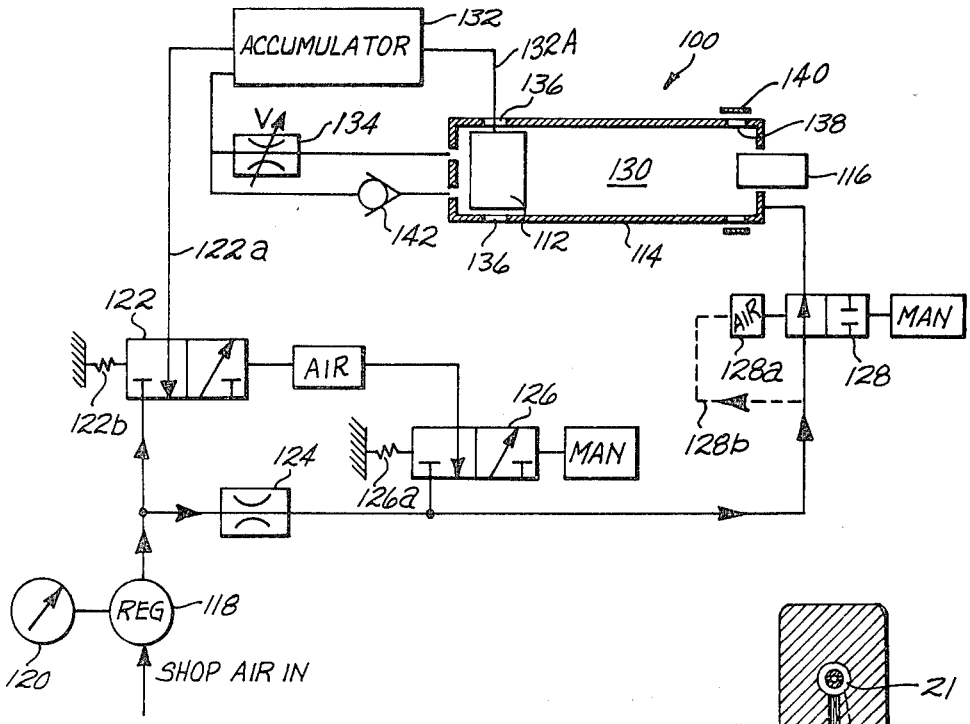
Fig. 2
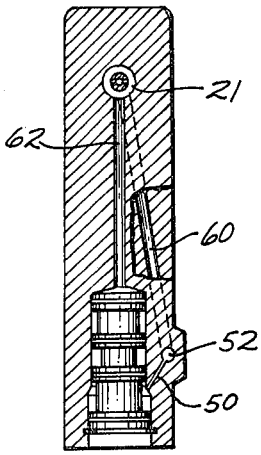
Fig. 4
Fig. 3
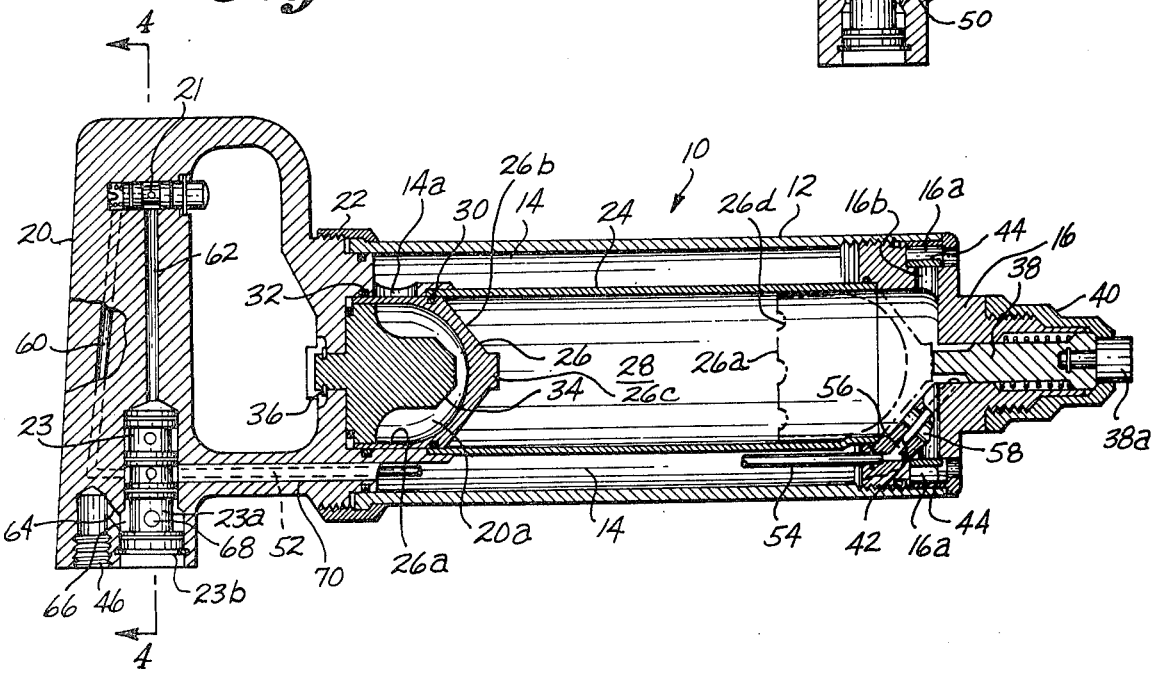

PNEUMATIC IMPACT GUN

CROSS REFERENCE TO RELATED APPLICATIONS

This application is a continuation-in-part of application Ser. No. 699,772, filed June 25,1976, now U.S. Pat. No. 4,039,034, which is a continuation-in-part of application Ser. No. 591,972, filed June 30, 1975, now abandoned.

BACKGROUND OF THE INVENTION

1. Field of the Invention

The present invention relates to riveting devices and more particularly to a pneumatic impact gun designed to upset conventional rivets in a single impact.

2. Description of the Prior Art

The majority of pneumatic impact guns presently marketed require that a plurality of impacts be effectuated in order to upset a rivet. Such a plurality of impacts is undersirable for several reasons. First, attendant noise levels are often objectionable. For instance, the Federal Government's Office of Safety and Health Administration has promulgated standards in order to reduce noise levels in factories and other industrial areas. Furthermore, a lightweight pneumatic gun which upsets rivets in a single impact would greatly reduce the time required in the aircraft industry to rivet component sheets of a fuselage, wing skin, etc.

In order to provide a lightweight pneumatic single impact riveting gun, the present invention contemplates the use of a novel accumulator arrangement which will rapidly discharge or dump stored compressed air into a cylinder for actuation of a piston which will strike an anvil. The anvil impacts a rivet shank with sufficient energy to upset or form a button on the rivet in a single impact.

The Boeing Company has utilized pneumatic impact guns for many years, but there has not been a sufficiently lightweight single impact riveting gun until the present invention. In U.S. Pat. No. 3,559,269 by H. A. Schmitt et al., there is disclosed a high impact portable riveting apparatus. This patent provides for a sufficiently adequate single impact riveting apparatus, but requires the use of complex and expensive electric circuitry in order to adequately function. It is readily apparent that the present pneumatic impact system utilizing a lightweight gun sifficiently powerful to upset standard rivets in a single impact is greatly advantageous to the apparatus disclosed in the aforementioned patent.

SUMMARY OF THE INVENTION

It is an object of the present invention to provide a pneumatic impact gun which is actuated by a normally discharged accumulator and which further utilizes an interlock system to prevent accidental firing. The pneumatic impact gun of the present invention is designed as a lightweight tool in which the actuating piston travels at a high velocity in order to strike an associated anvil with sufficient force so that a rivet may be upset in a single impact.

Another object of the present invention is to provide a lightweight pneumatic impact gun which will obviate the requirement of multiple impacts and thereby improve the quality of installed rivets and improve the rivet button appearance. Furthermore, by eliminating a plurality of impacts objectionable noise will be substantially abated.

Yet another object of the present invention is to provide a lightweight pneumatic impact gun which incorporates a unique interlock system which provides for operator and work safety by preventing accidental discharge or firing of the impact gun when it is dropped or mis-handled. The interlock is used in conjunction with an accumulator which is normally discharged. The accumulator may only become charged with sufficient air pressure after the interlock and a trigger have been actuated.

A further object of the present invention is to provide a lightweight pneumatic impact gun which weighs approximately 5-½ pounds and is capable of upsetting 3/16-inch diameter rivets. Accompanying the lightweight construction of the impact gun of the present invention is a vertically offset handle which enables an operator to more fully adjust for recoil after the gun has been fired. The vertically offset handle centers the recoil mass (gun and operator's hand and arm) along the line of fire causing recoil travel to be parallel with the line of fire. As a result, the recoil of the gun is relatively straight and not off at an angle which would cause a non-uniform rivet button appearance.

Still another object of the present invention is to provide a lightweight pneumatic impact gun which may be altered in order to upset rivets of a larger or smaller diameter. For example, the accumulator volume may be changed in order to provide for different air volumes imparted to the actuating piston.

Yet another object of the present invention is to provide a lightweight pneumatic impact gun in which the cycle time for upsetting a rivet is extremely short, (approximating one second). Furthermore, the pneumatic impact gun of the present invention is constructed with parts which may be disassembled in approximately one minute or less, thereby making all components easily accessible for maintenance.

A still further object of the present invention is to provide a pneumatic impact gun lightweight in construction which has a minimal number of moving parts and which is relatively inexpensive to manufacture and maintain.

Additional objects of the present invention reside in the specific construction of the exemplary apparatus hereinafter particularly described in the specification and shown in the several drawings.

BRIEF DESCRIPTION OF THE DRAWINGS

Novel features of the improved lightweight pneumatic impact gun in accordance with the present invention will be more readily understood from a consideration of the following description, taken together with the accompanying drawings, in which a preferred adaptation is illustrated with the various parts thereof identified by suitable reference characters in each of the views, and in which:

FIG. 2 is an illustration of the air logic system of the present invention;

FIG. 3 is a cross-sectional view of the pneumatic impact gun of the present invention illustrating certain features not shown in FIG. 1;

FIG. 4 is a cross-sectional view of the handle taken along line 4—4 in FIG. 3.

DETAILED DESCRIPTION OF THE INVENTION

Figure 1:
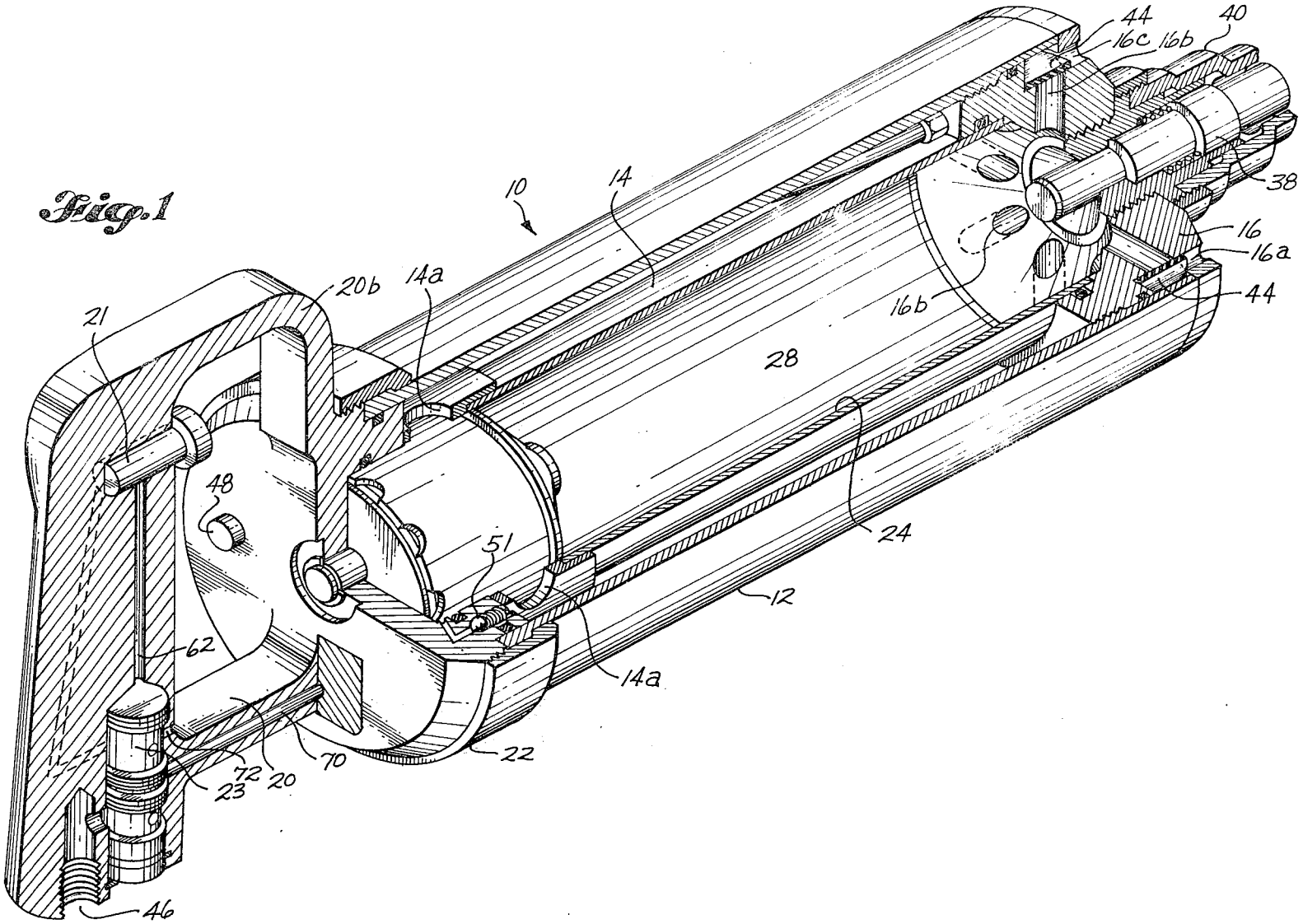
FIG. 1 is a cutaway view of the pneumatic impact gun illustrating the relationship of the cylinder and movable piston.

Reference is directed initially to FIG. 2 which illustrates an air logic system employed in the present invention. By considering this diagram, the operation of the present invention may be readily understood. Structural components are further illustrated in FIGS. 1, 3 and 4 and will be dsecribed later in detail.

As shown in FIG. 2, the pneumatic impact gun and attendant circuitry is generally designated at 100. A piston 112 is slidably arranged in a cylinder 114. An anvil 116 is disposed downstream of piston 112 and is utilized to strike a rivet to be upset. In the FIG. 2 air logic system embodiment, shop air is controlled by a pressure regulator 118 and gage 120. Typically, shop air pressure may be set to enter the system at approximately 100 p.s.i. Regulator 118 and gage 120 would normally be external to the gun and are optional equipment provided the air supply pressure is stable. A normally closed, three-way, two-position air pilot valve 122 remains initially closed and thus shop air passes through a restricter 124 and bypasses a trigger valve 126 so as to be admitted through an interlock 128 into cylinder chamber 130 for urging piston 112 to a normally home position.

In order to activate or fire the pneumatic impact gun 100, it is necessary for the two-way, two-position, normally open interlock valve 128 to be manually actuated to prevent shop air from flowing therethrough. If the normally closed, three-way, two-position trigger valve 126 is now actuated, shop air will pass through restricter 124 and through trigger valve 126 to actuate main valve 122. With main valve 122 permitting shop air to travel from the regulator 118 into accumulator 132 and energy selector 134, the pneumatic impact gun is set for operation. Energy selector 134 provides a time delay to permit accumulator 132 to charge. Energy selector 134 permits only a small amount of air to displace piston 112 beyond ports 136. As soon as piston 112 is displaced beyond ports 136, accumulator 132 has been sufficiently charged with pressurized air to permit same to be dumped rapidly from accumulator 132 into the cylinder as represented by line **132*a* to force piston 112 to the right, thereby striking anvil 116. As piston 112 travels at a high velocity through cylinder 114, exhaust air is forced through ports 138 past elastic band 140. Thus, the air is allowed to exhaust. As piston 112 impacts anvil 116, interlock valve 128 is deactivated through an air return 128*b*, thereby permitting shop air to once again enter into chamber 130 to displace piston 112 to a home or start position. The elastic band 140 provides a constant pressure to keep piston 112 in its "ready for fire" position. During the travel of piston 112 to the left, a certain amount of air is displaced through one-way valve 142 and is exhausted outwardly through line 122*a*. Elastic band 140 shuts off air flow past the exhaust ports 138 until a predetermined pressure is developed by the continuous air bleed through restricter 124. The resulting pressure is determined by the tension in the elastic band 140. Upon actuation or firing, the air flow is sufficient to move the elastic band 140 clear from the exhaust ports 138. Spring returns are diagrammatically indicated at 122*b* and 126*a*. An air return is indicated at 128*a***.

With reference now to FIGS. 1 and 3, specific construction details of the lightweight pneumatic single impact gun of the present invention will be fully described. The gun is represented generally at 10, and consists of a housing 12 having an accumulator cavity 14.

The pneumatic impact gun utilizes a housing 12 wherein an accumulator cavity 14 is arranged circumferentially therein. A cylinder head 16 is threadably secured at a forward end thereof and a handle assembly 20 is fastened at the other end by a nut 22. A cylinder 24 is contained between cylinder head 16 and handle assembly 20. Contained within cylinder 24 is a piston 26 which travels in cavity 28 of cylinder 24.

Piston 26 is a thin-walled cylinder with a hemispherical dome cap at the downstream end, and a socket cavity **20*a* at the upstream end. The hemispherical dome cap has shoulder 26*b* arranged radially at its base, and boss 26*c* located at the crown. Boss 26*c* is a wear surface for impacting anvil 38. Contained radially within shoulder 26*b* is a narrow groove (not shown) to retain O-ring seal 30**.

At the upstream end of piston 26 is an external chamfer (not shown) arranged radially around the open-end of the cylinder. Within said chamfer are a plurality of shallow scallops **26*d* (shown by phantom lines in FIG. 3) to provide an air passage for the air coming from admitting means 48. The chamfer provides a means to engage seal 32 which is located in the wall of cylinder 24**.

Socket cavity **20*a*, within handle assembly 20, contains seal 32 arranged in a radial manner to seal the outside surface of piston 26 during the time the piston is in the upstream position. As piston 26 moves downstream, and when scallops 26*d* clear seal 32, the supply of air is unloaded into the void behind piston 26, causing piston 26 to rapidly move downstream and impact anvil 38**.

Plug 34 located within handle socket cavity **20*a* displaces a volume of air within the upstream side of piston 26. Since the walls of piston 26 are thin, plug 34 retains seal 32 within socket cavity 20*a* of handle assembly 20 when piston 26** is in the downstream position.

In the preferred embodiment, piston 26 is constructed from steel. A Teflon bearing surface is provided on the side of piston 26 which contacts the walls of cylinder 24.

Cylinder head 16 further comprises an anvil 38 within anvil housing 40. A shuttle 42 and elastic band 44 are also located in cylinder head 16. Handle assembly 20 further contains a trigger valve 21, a main valve 23 and an air intake 46. A check valve 51 is utilized in conjunction with an adjustable metering valve 48 and a restricter passage 50 which leads to passage 52 (shown in FIG. 4) connected to tube 54.

Passage 62 connects trigger valve 21 to main valve 23. Main valve 23 is retained by a retainer **23*a* and retaining ring 23*b*. Passage 64 connects an air intake 46 to a main valve cavity 66. Main valve cavity 66 feeds restricter passage 50 and retainer ports 68 located in retainer 23*a*. A passage 70 connects main valve cavity 66 to accumulator 14 and check valve 51 connects cavity 20*a* and cavity 14 allowing flow from cavity 20*a* to cavity 14 but checking reverse flow. Adjustable metering valve 48 connects cavities 20*a* and 14 for metering high pressure flow from cavity 14 to cavity 20*a*. High pressure air is exhausted from main valve cavity 66 to atmosphere by means of exhaust passage 72. Ports 14*a* connect cavities 14 and 20*a* for high volume high pressure flow. Cylinder head 16 utilizes cavities 16*a* which further incorporates elastic band 44. Ports 16*b* connect cavities 28 and 16***a*. Ports 16*c* connect cavity 16*a* to the atmosphere.

OPERATION OF THE PNEUMATIC IMPACT GUN

Initially conpressed air from a source of supply is connected to air intake 46. Restricter passage 50 provides for a controlled volume of air flow to passage 52. The controlled volume of air flow enters cavity 28 through tube 54, passage 56, and port 58 into cylinder head 16. The controlled volume of air then flows to atmosphere through ports 16*b* and 16*c*. Elastic band 44 resists the flow and causes a low pressure to result in cavity 28, thereby providing a means to return piston 26 to a home position and retain it there after firing of the gun.

Air flow in passage 56 retains shuttle 42 against anvil 38 which keeps port 58 open. With 58 in an open position, there exists low pressure in passages 56, 54, 52 and 60 because the air flow is restricted at passage 50. With low pressure existing in passage 60, manual actuation of trigger valve 21 will activate main valve 23. Such a system provides an interlock to prevent accidental firing of the gun.

However, when anvil 38 is pressed against a rivet preparatory to firing the gun, shuttle 42 is caused to travel rearwardly in passage 56 to thereby block port 58, and the continued flow through restricter 50 results in passages 52 and 60 having a high pressure buildup and therefore manual operation of trigger valve 21 will actuate main valve 23. When main valve 23 is actuated, there is a high pressure, large volume of flow induced into cavity 14 from air intake 46. As pressure builds in cavity 14, there is a metered air flow therefrom to cavity 20*a* through metering valve 48 which builds a low pressure condition in cavity 20*a*, thereby causing piston 26 to move to the right as seen in FIGS. 1 and 3. As piston 26 clears seal 32, a large volume of air travels from cavity 14 to cavity 20*a* through ports 14*a* in a very short period of time, thereby accelerating piston 26 and storing kinetic energy in piston 26. When piston 26 strikes anvil 38, a button is formed upon a fastener or rivet. Exhaust air escapes to the atmosphere past elastic band 44 through ports 16*b* and 16*c* during the aforementioned working stroke. When anvil 38 is in home position, shuttle 42 is allowed to return, which thereby opens port 58. The procedure bleeds air from passage 52 annd reduces the pressure, thereby deactivating main valve 23 and allowing high pressure exhaust to the atmosphere through main valve 23 and passage 70.

Air pressure in cavities 20*a* and 14 is exhausted to the atmosphere through ports 14*a*, passage 70, cavity 64, and exhaust port 72. The low pressure in cavity 28 will return the piston 26 home. Check valve 51 is utilized to bleed pressure from cavity 20*a* to cavity 14 after seal 32 is engaged. The gun is now ready for a repeat cycle. By utilizing the pneumatic impact gun of the present invention, cycle times of approximately one second have been realized.

The amount of energy imparted to piston 26 may be varied by adjusting air flow to metering valve 48 to cause a longer or shorter time delay to charge cavity 28 and displace piston 26 past seal 32 to fire. This longer or shorter time delay will allow accumulator cavity 14 to receive either a higher or lower pressure charge before firing. If a higher pressure charge is effectuated, the gun will deliver more energy at the corresponding higher accumulator pressures. an essential feature to be emphasized is the fact that accumulator cavity 14 is normally discharged.

Metering valve 48 may take the form of a needle valve or other conventional valving systems. However, it has been found that an eccentric valve arrangement may prove particularly beneficial. Such a metering valve cannot be jammed as can a conventional needle valve, and it is easily calibrated by design.

It is to be further noted that handle 20 incorporates a raised segment 20*b* which enables an operator's arm and wrist to be in line with the line of fire so that the gun does not tilt at an angle upon recoil.

While a certain exemplary embodiment of the present invention has been hereinabove desscribed and shown in the drawings, it is to be understood that such an embodiment is mereby illustrative of, and not restrictive on, the broad invention. Thus, the invention should not be limited to the specific construction or arrangement shown and described, since various other obvious modifications may occur to persons having ordinary skill in the art.

What is claimed is:

1. A pneumatic impact gun for upsetting one end of a rivet in a single impact comprising:

piston means slidably arranged in a cylinder for impacting an anvil disposed at the downstream end of said cylinder;

means for admitting a manually adjustable flow of air into said cylinder to displace said piston means a predetermined distance downstream within said cylinder over a variable time;

means for storing an accumulated charge of compressed air arranged to communicate with said piston means; and, means for passing compressed air from said storage means so that when said piston means has been displaced a predetermined distance by the flow of compressed air from said admitting means, said storing means dumps an accumulated charge of compressed air into contact with the upstream side of said piston means to displace said piston means rapidly downstream in said cylinder to thereupon impact said anvil, wherein said piston means comprises a thin-walled circular cylinder with a hemispherical dome at the downstream end, said dome carrying shoulders therein and a boss thereon, said boss impacting said anvil when said piston moves downstream.

2. The piston of claim 1 wherein said shoulders contain a groove radially disposed therein, said groove retaining a seal.

3. The impact gun of claim 1 wherein said piston is made of steel.

* * * * *